US006607011B2

(12) United States Patent
Towfighi

(10) Patent No.: US 6,607,011 B2
(45) Date of Patent: Aug. 19, 2003

(54) PRESSURIZED CONTAINER AND METHOD OF FILLING IT

(75) Inventor: Kaveh Towfighi, Sigmarazell (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/952,156

(22) Filed: Sep. 14, 2001

(65) Prior Publication Data

US 2002/0033394 A1 Mar. 21, 2002

(30) Foreign Application Priority Data

Sep. 15, 2002 (DE) ..... 100 461 40.2

(51) Int. Cl.[7] ..... B65B 1/04; B65B 3/04

(52) U.S. Cl. ..... 141/3; 141/2; 141/18; 141/20; 222/402.16

(58) Field of Search ..... 141/2, 3, 18, 20; 222/402.1, 402.16, 394

(56) References Cited

U.S. PATENT DOCUMENTS 3,237,659 A * 3/1966 Albrecht ..... 141/20
3,375,957 A * 4/1968 Kuffer ..... 222/402.16
6,152,190 A * 11/2000 Smith ..... 141/3

* cited by examiner

*Primary Examiner*—Timothy L. Maust
(74) *Attorney, Agent, or Firm*—Sidley Austin Brown & Wood, LLP

(57) ABSTRACT

A pressurized container (1) with crimped surfaces (2, 2', 2") at contact regions (3, 3') on the two surfaces (2, 2", 2', 2") are sealed gas-tight by crimping and with a gas-tight sealing compound (4) as an intermediate layer between the two surfaces (2-2', 2'-2"). The gas-tight sealing compound (4) is applied between the surfaces (2-2', 2'-2") of the pressurized can (1) before the crimping.

7 Claims, 1 Drawing Sheet

PRESSURIZED CONTAINER AND METHOD OF FILLING IT

BACKGROUND OF THE INVENTION

The invention refers to a pressurized container, such as a hand-operated spray can, preferably for holding gaseous propelled liquids such as chemical reaction mixtures like foams, as well as a method for filling the pressurized container.

On a face that closes the pot-shaped jacket with an integrated base a valve disk closes an open end, such pressurized cans have a hand-operable valve for a regulated, metered release of the contents.

Such faces used as valve disks arc normally made of sheet metal that is crimped on the inside around the circumference with the free end of the jacket of the pressurized container by joint plastic deformation. Additional crimping is carried out between the axially jacket-shaped hole of the valve disk and the valve housing that is attached coaxially therein.

A drawback of such crimped pressurized cans, to which this invention refers, is that occasional leaks develop. Moreover, due to the fact that the seal between the face and the jacket frequently acts only along a line, an increased pressure loss occurs because of interfacial diffusion, as a result of which the storage time prior to use of the product is limited. Due to alternating mechanical stress, the actuation of the valve during the filling and by the user additionally causes a reduction or loss of the seal that acts only along a line.

Therefore, with such pressurized cans, resin materials are used as sealing compounds which cover the two surfaces that are joined by the crimping and which seal on at least one side of the resulting total surface in a gas-tight manner. The resin material is normally inserted into the pressurized can when it is filled, whereby the surface of the pressurized can that is to be scaled is oriented downwards. This process, however, can only be used when the gaseous propellant is air.

SUMMARY OF THE INVENTION

The object of the invention is to provide a technologically simple embodiment of a pressurized container and an associated method which considerably reduces leaking and/or the pressure loss in pressurized containers.

Essentially, in the case of a pressurized container with crimped surfaces, the contact regions, at least partially, have a gas-tight sealing compound as an intermediate layer between the two surfaces. For this purpose, a gas-tight sealing compound is inserted into the pressurized container before the crimping.

The intermediate layer of the gas-tight sealing compound always forms a surface-covering seal between the two crimped surfaces that are to be sealed. Moreover, a bead that protrudes on both sides relative to the resulting surface acts as a mechanical support in case of mechanical stress, especially of the valve. This is particularly advantageous during the filling process and during the utilization.

The gas-tight sealing compound that has not yet cured is advantageously thixotropically flowable, as a result of which it does not drip.

Advantageously, the pressurized can is heated up after the scaling compound has been inserted.

Preferably, the crimping is carried out only after the sealing compound has at least partially cured.

Advantageously, the gas-tight sealing compound cures over time by meant of a chemical reaction that takes place with the gas that is present as the propellant and/or with the liquid contents.

Preferably, the gas-tight sealing compound is a cross-linkable, end-elastic reaction resin.

The method of filling takes place essentially as follows:

1. Application of the flowable gas-tight scaling compound on at least one region or one of the surfaces of the pressurized can that face each other during the crimping.
2. Optional heating of the pressurized can in order to accelerate the curing process.
3. Optional waiting for a time needed for at least partial curing.
4. Crimping of the surfaces.
5. Filling of the pressurized can with its contents.

BRIEF DESCRIPTION OF THE DRAWING

The invention is explained in greater depth with reference to an advantageous embodiment in the drawing in which.

DETAILED DESCRIPTION OF THE DRAWING

Figure 1:
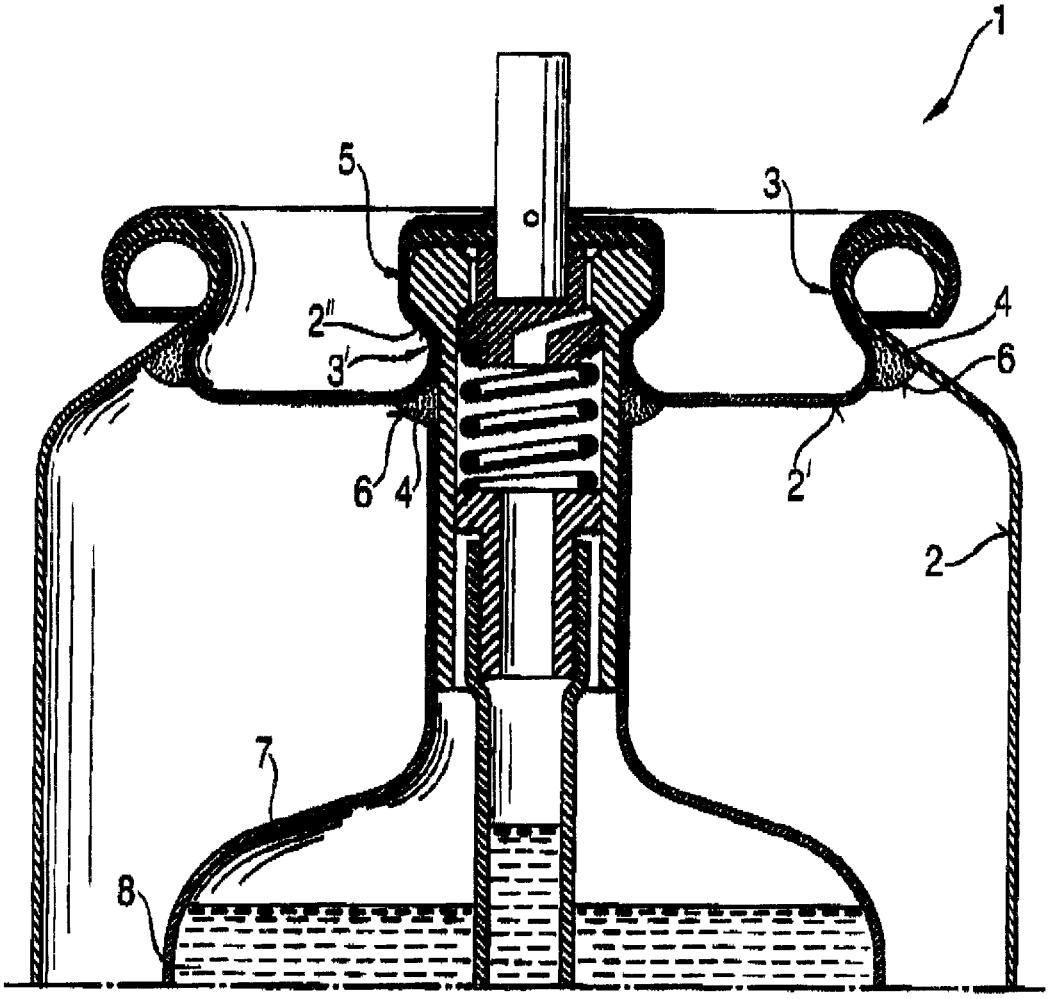
FIG. 1 is a partial sectional view of a pressurized container embodying the present invention.

As shown in FIG. 1, a pressurized container is formed of a pot-shaped jacket 2 open at its upper end which is closed by a valve disc supporting a valve 5. In addition a first contact region 3 is formed at the radially outer end of the jacket 2 and the radially outer surface 2' of the valve disc and a second contact region 3' is formed at the surface of the valve 5 and the radially inner surface 2" of the valve disc. The two contact regions are crimped with an intermediate layer between the crimped surfaces. The intermediate layer is a sealing compound 4 and in combination with the crimping provides a gas-tight seal. The valve 5 positioned co-axially on the surface 2" is sealed in this manner.

On the inside and outside of the first and second contact region, beads 6 are formed by tho gas-tight sealing compound 4.

The pressurized container has contents 8 to be sprayed located within a bag 7.

What is claimed is:

1. A pressurized container for dispensing gaseous propelled contents, comprising a pot-shaped container (1) having an open end with an annular surface (2), a valve disc forming a closure for said open end and comprising a radially outer surface (2') for contact with said annular surface (2) of said container and a radially inner surface (2") for contact with a radially inner annular surface of a dispensing valve (5), a flowable gas-tight sealing compound positioned at a first contact region (3) between said radially outer surface (2') of said valve disk and said annular surface (2) of said container and at a second contact region (3') between said radially inner surface (2") of said valve disc and said annular surface of said dispensing valve and at least partially forms an intermediate layer therebetween and where said first and second contact regions are crimped together to form a gas-tight seal.

2. A pressurized container, as set forth in claim 1, wherein said sealing compound forms heads (6) protruding at least at one of into and out of said contact regions of said pressurized container.

3. A pressurized container, as set forth in claim 2, wherein said gas-tight scaling compound cures following the crimping of the gas-tight seal.

4. A pressurized container, as set forth in claim 3, wherein said gas-tight sealing compound is cured over time by a chemical reaction with contents (8) of said pressurized container.

5. A pressurized container, as set forth in claim 1, wherein said gas-tight sealing compound is a cross-linkable, end-elastic reaction resin.

6. A method of filling a pressurized container with contents to be dispensed by gaseous propulsion comprising the steps of applying a flowable gas-tight sealing compound to at least one annular abutting area of the pressurized container and a valve disc for an open end of the container, crimping the abutting area of the pressurized container and valve disc, and as a final method step, filling the pressurized can with the contents to be dispensed, after at least the step of applying the sealing compound heating the pressurized container.

7. A method of filling, as set forth in claim 6, wherein after the step of applying the sealing compound having a waiting period for at least partially curing of the sealing compound.

* * * * *